US009250035B2

(12) United States Patent
Sullivan et al.

(10) Patent No.: US 9,250,035 B2
(45) Date of Patent: Feb. 2, 2016

(54) PRECISION AIMING SYSTEM FOR A WEAPON

(71) Applicant: KMS CONSULTING, LLC, Kennebunk, ME (US)

(72) Inventors: Kevin Michael Sullivan, Kennebunk, ME (US); Marcelo Eduardo Martinez, Cordoba (AR)

(73) Assignee: KMS CONSULTING, LLC, Kennebunk, ME (US)

( * ) Notice: Subject to any disclaimer, the term of this patent is extended or adjusted under 35 U.S.C. 154(b) by 0 days.

(21) Appl. No.: 14/221,313

(22) Filed: Mar. 21, 2014

(65) Prior Publication Data

US 2014/0283429 A1 Sep. 25, 2014

Related U.S. Application Data

(60) Provisional application No. 61/803,824, filed on Mar. 21, 2013.

(51) Int. Cl.
*F41G 3/08* (2006.01)
*F41G 1/00* (2006.01)
(Continued)

(52) U.S. Cl.
CPC .. *F41G 1/00* (2013.01); *F41G 1/38* (2013.01); *F41G 1/44* (2013.01); *F41G 3/06* (2013.01); *F41G 3/08* (2013.01); *F41G 3/12* (2013.01); *F41G 3/142* (2013.01); *F41G 11/003* (2013.01)

(58) Field of Classification Search
CPC ..... F41G 3/08; F41G 3/10; F41G 3/12; F41G 3/06; F41G 5/16; F41G 3/142; F41G 1/38; F41G 1/44; F41G 1/00; F41G 11/003
USPC ..... 89/41.11, 200, 201, 202, 203, 204, 205, 89/206
See application file for complete search history.

(56) References Cited

U.S. PATENT DOCUMENTS 5,413,029 A 5/1995 Gent et al.
5,826,363 A 10/1998 Olson
(Continued)

FOREIGN PATENT DOCUMENTS

DE 3603521 A1 8/1987
DE 19719977 C1 10/1998
(Continued)

OTHER PUBLICATIONS

"The Effects of Augmented Auditor Effects of Augmented Feedback on Psychomotor Skill Learning in Precision Shooting" by N. Kontinnen et al., Journal of Sport & Exercise Pyschology, 2004, 26,306-316.
(Continued)

*Primary Examiner* — Stephen M Johnson
(74) *Attorney, Agent, or Firm* — Karl F. Milde, Jr.; Eckert Seamans Cherin & Mellott, LLC

(57) ABSTRACT

A system for precision aiming of a weapon that has a rail, aligned with a centerline of its barrel, with a bus for supplying power to, and providing communication between, a plurality of modular system components that are mounted and precisely aligned in an array on the rail. A core component receives data from the sensor components via the rail and produces an output for display of aiming data which allows an operator to precisely aim the weapon at a selected target.

13 Claims, 6 Drawing Sheets

(51) Int. Cl.

| | |
|---|---|
| ***F41G 11/00*** | (2006.01) |
| ***F41G 3/06*** | (2006.01) |
| ***F41G 3/12*** | (2006.01) |
| ***F41G 3/14*** | (2006.01) |
| ***F41G 1/38*** | (2006.01) |
| ***F41G 1/44*** | (2006.01) |

(56) References Cited

U.S. PATENT DOCUMENTS

| | | | | |
|---|---|---|---|---|
| 6,064,197 | A | 5/2000 | Lochmann et al. | |
| 6,644,111 | B2 | 11/2003 | Cytron et al. | |
| 7,082,823 | B1 | 8/2006 | Shipman et al. | |
| 7,627,975 | B1 | 12/2009 | Hines | |
| 7,825,850 | B2 | 11/2010 | Frick | |
| 8,046,203 | B2 | 10/2011 | Blevins et al. | |
| 8,091,265 | B1 | 1/2012 | Teetzel et al. | |
| 8,117,778 | B2 | 2/2012 | Clark et al. | |
| 8,141,288 | B2 | 3/2012 | Dodd et al. | |
| 8,146,282 | B2 | 4/2012 | Cabahug et al. | |
| 8,245,623 | B2 | 8/2012 | Weaver | |
| 8,322,064 | B2 | 12/2012 | Cabahug et al. | |
| 8,336,776 | B2 | 12/2012 | Horvath et al. | |
| 8,397,418 | B2 | 3/2013 | Cabahug et al. | |
| 8,402,683 | B2 | 3/2013 | Cabahug et al. | |
| 8,443,539 | B2 | 5/2013 | Cabahug et al. | |
| 8,448,368 | B2 | 5/2013 | Cabahug et al. | |
| 8,490,313 | B2 | 7/2013 | Frascati et al. | |
| 8,516,731 | B2 | 8/2013 | Cabahug et al. | |
| 8,555,771 | B2 | 10/2013 | Kude | |
| 8,739,672 | B1 * | 6/2014 | Kelly | 89/1.11 |
| 2006/0005447 | A1 | 1/2006 | Lenner et al. | |
| 2009/0089001 | A1 | 4/2009 | Lin | |
| 2009/0313874 | A1 | 12/2009 | Griffin | |
| 2010/0031552 | A1 | 2/2010 | Houde-Walter | |
| 2010/0199745 | A1 * | 8/2010 | Mooty et al. | 73/12.11 |
| 2010/0251557 | A1 | 10/2010 | Albo et al. | |
| 2011/0315767 | A1 | 12/2011 | Lowrance | |
| 2012/0000979 | A1 * | 1/2012 | Horvath et al. | 235/407 |
| 2012/0097741 | A1 | 4/2012 | Karcher | |
| 2012/0144716 | A1 | 6/2012 | Cabahug et al. | |
| 2012/0145786 | A1 | 6/2012 | Weaver | |
| 2012/0255213 | A1 | 10/2012 | Panos | |
| 2013/0061504 | A1 | 3/2013 | Malherbe et al. | |
| 2013/0333266 | A1 | 12/2013 | Gose et al. | |

FOREIGN PATENT DOCUMENTS

| | | | |
|---|---|---|---|
| FR | 2788845 | A1 | 1/1999 |
| WO | 2008048116 | A1 | 10/2008 |
| WO | 2012146532 | A2 | 4/2012 |
| WO | 2012131548 | A1 | 10/2012 |

OTHER PUBLICATIONS

"Closing the Gap: Developing the Sharpshooter Capability in the CF" by S. Grant, www.armyforces.go.ca/caj.
"Effects of Augmented Feedback on Motor Skill Learning in Shooting" by K. Mononen, Studies in Sport, Physical Education and Health, vol. 122, year 2004.
"The Influence of Muscle Tremor on Shooting Performance" by M. Lakie, Experimental Physiology, 95:3 pp. 441-4450, year 2010.
"Parrallax in Rifle Scopes" www.opticsplace.com, 1 page.
"An Exploratory Investigation of the Effect of Individualized Computer-Based Instruction on Rifle Marksmanship Performance and Skill" by G. Chung et al., 2009, Cresst Report 754, Natl. Ctr. for Research on Evaluation, Standards and Student Testing.
"Using Motion Capture to Determine Marksmanship Shooting Profiles: Teaching Soldiers to Shoot Better Faster" by W. Platte et al., 2008 Thesis, MOVES Institute, Naval Postgraduate School.
"The Intelligent Rail"; info@tworxventures.com, 2 pages.
"Kalman Filter for Dummies"; bilgin.esme.org/BitsBytes/KalmanFilterforDummies.aspx, 5 pages.

* cited by examiner

PRECISION AIMING SYSTEM FOR A WEAPON

CROSS-REFERENCE TO RELATED APPLICATION

This application claims priority from the U.S. Provisional Application No. 61/803,824 filed Mar. 21, 2013.

BACKGROUND OF THE INVENTION

The present invention relates to a precision aiming system for a weapon having a barrel for firing a projectile and a rail aligned with the centerline of the barrel for mounting accessories on the weapon.

As used herein, the term "weapon" is intended to mean any type of firearm, be it a rifle, mortar, shoulder launched weapon or the like, which is either manually or automatically aimed to shoot at a target.

The current high demand for weapons has created a dynamic weapons' accessory market within the firearms industry. This trend started in the 1990s when Knight Armament Company and SOCOM worked closely together to field a standardized firearms rail kit allowing electro-optical manufacturers to provide modular components. Today there is a huge array of accessories designed to fit on the Knight rail system which uses two principle rail dimensional standards.

At about the turn of the twenty-first century, NATO began studying the concept of sharing power among rail components. The overall goal of this program was to develop a set of weapon accessories that collectively shared one power source, thereby reducing the carried load of the solider.

Concurrently with the NATO effort, DARPA announced a programs to improve the aim of a weapon so as to reach a target in a single first shot. Industry also began developing fire control systems with integrated sensors with the goal of advancing the technology with integrated "toolkits" of high end sensors. This effort resulted in users creating their own optimized advanced fire control systems with custom-selected integrated sensors. This led finally to the selection of standardized weapons by the military services and law enforcement agencies while it also allowed members of tactical teams and individual users to design "mission kits" of interoperable sensor arrays without redundancy.

With this perspective, it may be seen that the introduction of modular rail systems has allowed for a high degree of tailoring by weapons users. The United States Marines outfit their rifles' rail system with a kit that is different than the rail kit for a U.S. Army soldier. Within US SOCOM, all commands and different units again outfit their kit of accessories with different rail-attachable components. The variations in mission objectives create a strong user preference for fitting accessories to the kit based on a specific, precise mission.

Prior research in the art of improving the aim of a weapon is documented in the following references, the subject matter of which is incorporated herein by reference and made a part of the present disclosure:

1) "The Effects of Augmented Auditory Feedback on Psychomotor Skill Learning in Precision Shooting" by N. Kontinnen et al., *Journal of Sport & Exercise Psychology,* 2004, 26, 306-316;
2) "Closing the Gap: Developing the Sharpshooter Capability in the CF" by S. Grant, www.armyforces.gc.ca/caj;
3) "Effects of Augmented Feedback on Motor Skill Learning in Shooting" by K. Mononen, *Studies in Sport, Physical Education and Health*, Vol. 122;

4) "The Influence of Muscle Tremor on Shooting Performance" by M. Lakie, *Experimental Physiology,* 95.3 pp 441-450;
5) "Parallax in Rifle Scopes" www.opticsplace.com
6) "An Exploratory Investigation of the Effect of Individualized Computer-Based Instruction on Rifle Marksmanship Performance and Skill" by G. Chung at al., 2009, Cresst Report 754, Natl. Ctr. for Research on Evaluation, Standards and Student Testing; and
7) "Using Motion Capture to Determine Marksmanship Shooting Profiles: Teaching Soldiers to Shoot Better Faster" by W. Platte et al., 2008 Thesis, MOVES Institute, Naval Postgraduate School.

SUMMARY OF THE INVENTION

The principal objective of the present invention, therefore, is to provide a weapon system with a geometrically aligned array of modular state-of-the art sensors, input devices and displays that provide for precision aiming of the weapon.

It is a further objective of the present invention to provide a plurality of aligned modular sensors, input devices and graphic output displays forming a "tool kit" for improving the aim of the weapon.

It is a still further objective of the present invention to utilize "current state" and "past state" sensor data, along with filters and programmed logic subroutines, to optimize the precision of weapon aim.

It is a still further objective of the present invention to provide a "core device" comprising a CPU that receives sensor data and runs the programmed logic subroutines and ballistic algorithms for sorting and storing data that were recorded from "past state" sensors to optimize the precision of weapon aim.

It is a still further objective of the present invention to provide key sensors for "Angular and Movement Detection" (AMD).

It is a still further objective of the present invention to utilize a standardized rail system for a weapon to provides mechanical alignment of sensors in the array while additionally providing a means of powering and communicating between the components of the system.

If is a still further objective of the present invention to geometrically align sensors and a core device on a weapon rail system so that both current and past state data sets are recorded with geometric alignment and tight sensor position tolerance.

It is a still further objective of the present invention to further improve weapon "bore sighting" by automating detection, recording and correction of bias errors that are unique to every sensor array, weapon and shooter.

It is a still further objective of the present invention to run certain processing subroutines that effectively utilize and compare both currant state data and past state data and characterize bias errors to provide improved $2^{nd}$ shot aiming.

It is a still further objective of the present invention to design and provide a modular "tool kit" which takes full advantage of the standardized rail system to compute precise aiming data from a large selection of electronic sensors that are attachable to the rail.

These objectives, as well as further objectives which will become apparent from the discussion that follows, are achieved in accordance with the present invention, by providing a system for precision aiming of a weapon that has a rail, aligned with a centerline of its barrel, with a bus for supplying power to, and providing communication between, a plurality of modular system components that are mounted and precisely aligned in an array on the rail, these components may include, but are not limited to:

(a) A core component configured to be mechanically mounted on and electrically coupled to the rail. This core component, which includes a central processor unit and a data memory, receives power and electronically communicates with other components via the rail bus. The processor is operable to receive data from the memory and from one or more system components attached to the rail and to produce aiming data useful to an operator for precision aiming of the weapon.

(b) An input device configured to be mechanically mounted on and electrically coupled to the rail for receiving external data and operator commands for use by the core component.

(c) An output display configured to be mechanically mounted on and electrically coupled to the rail for displaying aiming data produced by the core component.

(d) One or more electronic sensor components configured to be mechanically mounted on, and electrically coupled to, the rail for providing data to the core component. These sensor components are selected from among the following components to provide a "tool kit" for a particular mission:

(1) an optical sensor configured to detect light received from a projectile fired from the weapon;

(2) a range finder configured to determine range to a target;

(3) a temperature sensor configured to detect ambient temperature;

(4) an air pressure sensor configured to detect ambient air pressure;

(5) an humidity sensor configured to defect the relative humidity in the air;

(6) a GPS locator con-figured to detect a current location;

(7) a magnetic compass configured to detect earth's magnetic field;

(8) a muzzle velocity sensor configured to detect a velocity of the projectile fired from the weapon;

(9) a yaw angle sensor configured to detect yaw of the gun barrel during firing;

(10) a wind sensor configured to detect wind direction and velocity;

(11) a wind gust and turbulence sensor configured to detect wind turbulence;

(12) a target location sensor configured to determine spatial coordinates at a target location;

(13) a geodesic sensor to determine terrain at a target location; and

(14) a projectile location sensor that determines an observed location of a projectile in flight According to the invention the core component receives data from the sensor components via the rail and produces an output for display of aiming data which allows an operator to precisely aim the weapon at a selected target.

Preferably the output device is an optical sight with a built-in electronic display that is configured to image the selected target with a cross-hair overlay.

Advantageously, the precision aiming system according to the invention also includes a laser source adapted to be mounted on the weapon and, when initiated by a command from either core component or the input device, is operative to illuminate a target with a laser beam. Preferably the laser source is also configured to be mechanically mounted on the rail and to communicate with the core component via the rail bus.

According to one feature of the invention, the core component includes an internal clock and is operable to generate a histogram of the barrel orientation and/or the barrel motion during firing of a projectile.

According to another feature, the core component includes one or more accelerometers and is operable to store accelerometer readings in the data memory.

According to still another feature, ballistic data is stored in the memory and the core component adjusts the aiming data for the output display in accordance with the ballistic data.

According to still another feature, ammunition lot data is stored in the memory and the core component adjusts the aiming data for the output display in accordance with such lot data.

According to still another feature, the core component includes filters and subroutines to validate input data and calculate ballistic solutions. One should note that the algorithm sub-routines codes housed in the "core" are capable of managing input and simultaneously processing solutions where multiple sensor data combinations exist. A subsequent subroutine further optimizes ballistic solutions by comparing current data to prior state data and finally a further subroutine utilizes a Kalman Filter logic to identify and calculate the "best fit" aiming solution.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
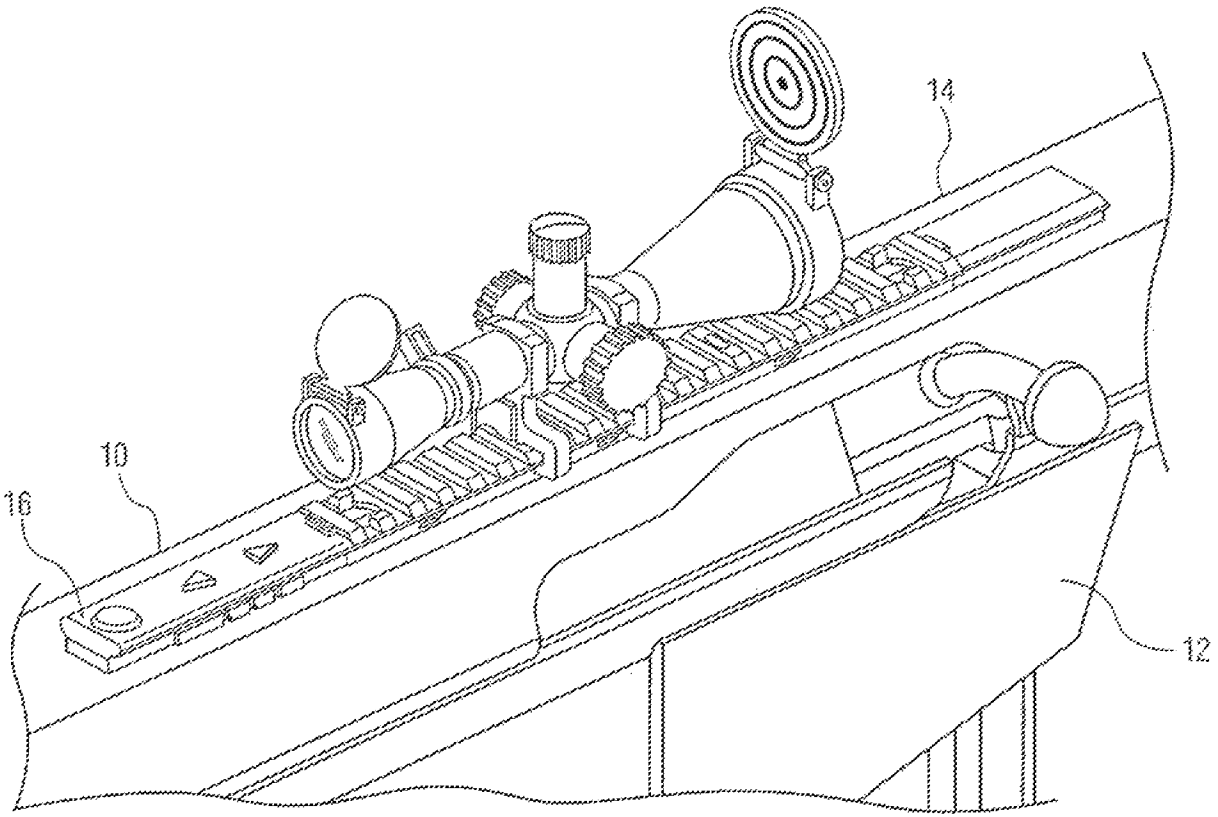
FIG. 1 is a perspective view (not to scale) showing a portion of a typical U.S. military standard (MIL-STD) weapon rail interface of the type to which the present invention relates.

The preferred embodiments of the present invention will now be described with reference to FIGS. 1-6 of the drawings.

Identical elements in the various figures are designated with the same reference numerals.

Recognizing the strong user desire to "kit out" weaponry with electro-optical and other components, the Third Generation Ballistic Rail provides an optimum interface between a weapon and electronic "smart" kit components that form the system according to the present invention. The rail has a standardized interface—e.g., RIS, RAS, MIL-STD 1913 or NATO standard—and a digital or analog bus that provides power to, and transfers data among, the array of electronic system components that function together to produce precise aiming data.

The system includes an array of electronic sensors and optical device (laser range finders, optical sights, laser illuminators, identification friend/foe (IFF), etc.) and other electronic components (GPS, etc.) mechanically mounted on the rail and a core component comprising a CPU and software which compiles available sensor data, merges available reference data and computes an optimum solution. The filters utilize available sensor data, with varying degrees of fidelity, from the array of sensors. The CPU with its software may be mechanically mounted on the rail as a modular component or may be located in a separate hand-held computer, smart phone or the like.

Array of Sensors:

The system according to the present invention advantageously incorporates a core component with an AMD physically aligned with the weapon's rail (and with the weapon's barrel bore). "Current" and "past" state sensors in the array are listed and identified in the Table below. At the time a shot is taken, sensor data is collected and recorded in memory. The ballistic algorithm in the core component then utilizes prior shot information, recorded prior state data and current state data to calculate and improved aiming point solutions.

TABLE

| System Sensors and Their Function | Sight (Note 1) | Solution | Improvement | Past (Prior) State | Current State |
|---|---|---|---|---|---|
| Angular + Movement Detection (3 axis) | X | X | X | X | X |
| GPS/Firing Position Data/Known Target Position Data | | X | | X | X |
| Range Finder | | X | | X | X |
| Temp Sensor | | X | | X | X |
| Air Pressure Sensor | | X | | X | X |
| Humidity Sensor | | X | | X | X |
| Magnetic Compass | | X | | X | X |
| Muzzle Velocity Sensor | | X | X | X | X |
| Yaw Angle Sensor | | X | X | X | |
| Wind @ Firing Point Sensor | | X | | X | X |
| Wind + Gust + Turbulence (in flight path) Sensor | | X | | X | X |
| Other | | X | X | | |
| Geodesic Sensor/Data Input | | X | | X | X |
| Registration Observation Sensor Reference Data | | | X | X | |
| Ammunition Lot MV | X | | | X | |
| Ammunition Lot Dispersion | X | | | X | |

(Note 1) Gunner Bias Error, Weapon Bias, Gun Wear History and Gun Jump

The system, including the CPU with programming software that includes truth table filters and algorithms along with the array of sensors and other components provide three methodologies to improve shot precision:

(1) an advanced, automated bore sight function to provide greater precision for the $1^{st}$ shot;

(2) A refined ballistic solution for the $1^{st}$ and subsequent shots; and (3) Analysis and refinement of shot data and the ballistics solution in $2^{nd}$ and subsequent shots.

The software program operating on the core's CPU continues to execute software code that refines the precision of aim points based on relevant prior state sensor (histograms) and, when available, utilizes actual shot fall data (registration measurements when such information is available).

Advantageously, an Angular and Movement Detection (AMD) package is provided to assess various degrees of sensor fidelity in the movement and angular position of the weapon. The AMD may consist of simple positional accelerometers, an inertial measurement unit, an attitude and heading reference system, and/or active gyro stabilization.

As the price-performance of electronics advances, users will be able to attach upgraded components to the system without the need to replace all sensors. The invention requires that the AMD be physically aligned with the rail, providing a known physical positional reference for all attached sensors. The rail alignment (or misalignment) is measurable and coded into the CPU memory and added to all ballistic solutions. Increasing degrees of sensor fidelity (as electronic technology and miniaturization advances take place) will allow users of the invention increasing capability in the precision of ballistic solutions (bore sight, refined ballistic solution and post-shot aim improvement).

The sensor devices transmit data to the "core" device using a data transmission protocol (interface standards) utilizing specific wave forms that are readable by the core device.

Display and Outputs:

Standardized software interface protocols display the aiming data. An advanced system may have a graphic user interface (GUI) and provide coaching and aiming tips. Additionally, displays and outputs may provide shot replay information.

Turning now to the drawings, FIG. 1 shows a standard rail 10 for a weapon 12 having galvanic USB or MIL-STD connectors 14 for power and data. Wireless (e.g., Bluetooth or WiFi) connections may also be provided to connect separate PDA's, laptops, smart phones and the like. This rail (which may, for example, be of the type disclosed in the U.S. Pat. No. 8,516,731) serves as a mechanical and electrical mount for weapon accessories such as a bore sight 18 and a core component 16 for the system according to the present invention.

Figure 2:
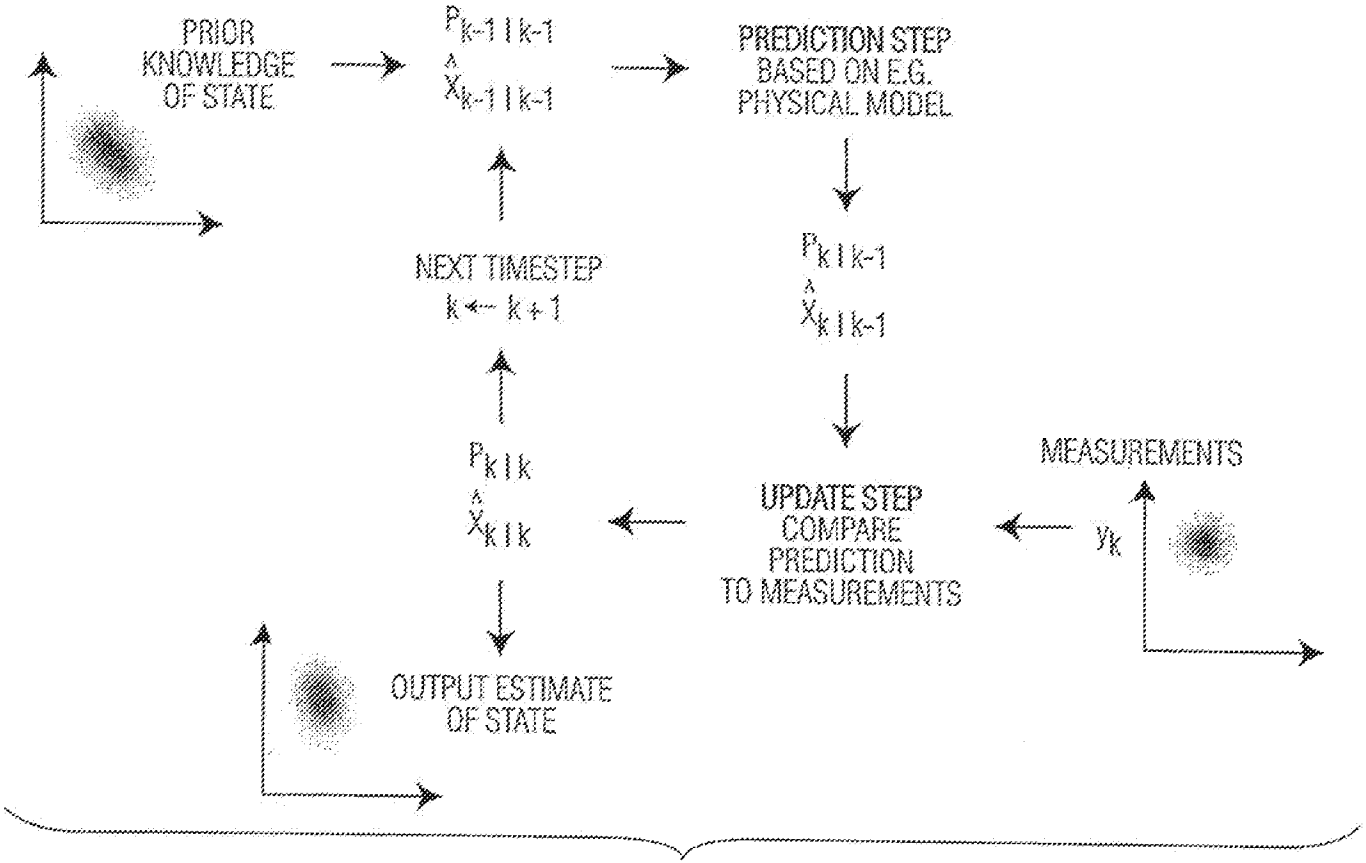
FIG. 2 is a flow charts showing the conceptual framework of calculations performed by the system according to the invention to produce an output for display of precision aiming data.

The general operation of the system according to the invention is illustrated in FIG. 2. The core component 16 receives weapon coordinate (X) and angular (P) data from a previous shot (k−1) and predicts the weapon orientation (X,P) required to hit the target on the next shot (k). After the shot is fired, its impact location is measured and a new prediction is calculated for the next shot, and so forth. Before each new shot, the system measures the weapon orientation data providing correction for the aiming of the weapon.

Figure 3:
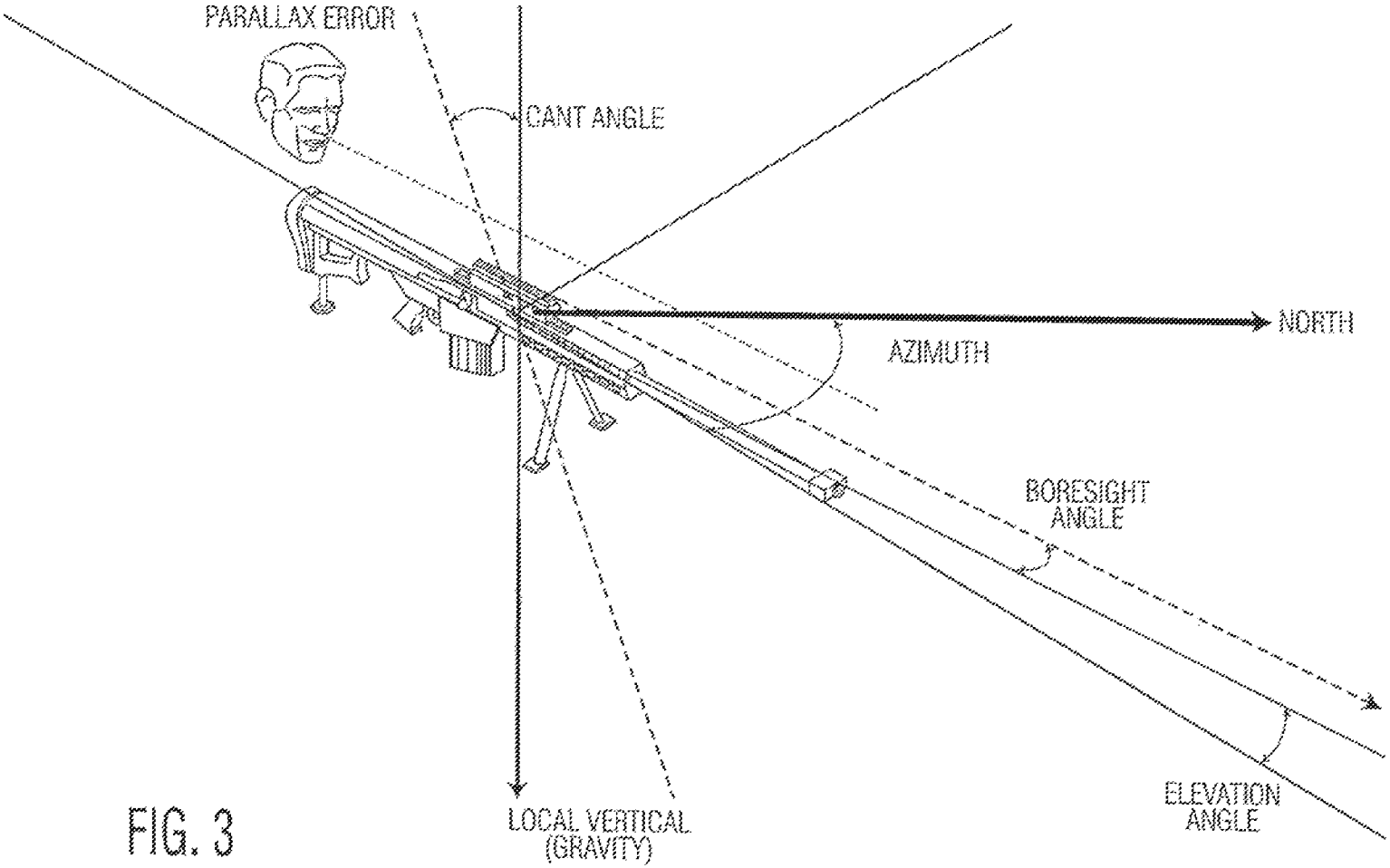
FIG. 3 is a perspective view of a weapon showing the key angular relationships which apply in a system for precision aiming of the weapon.

FIG. 3 illustrates the various coordinates and angles that define the weapon orientation. As may be seen, the longitudinal axis of the bore (bore sight 18) is measured with respect to the zenith (elevation angle) and the horizontal (azimuth angle) with respect to due north. Furthermore the cant of a line perpendicular to the bore sight is measured with respect to the zenith. One or more sensors measure these angles and supply this data to the core component 16.

Figure 4:
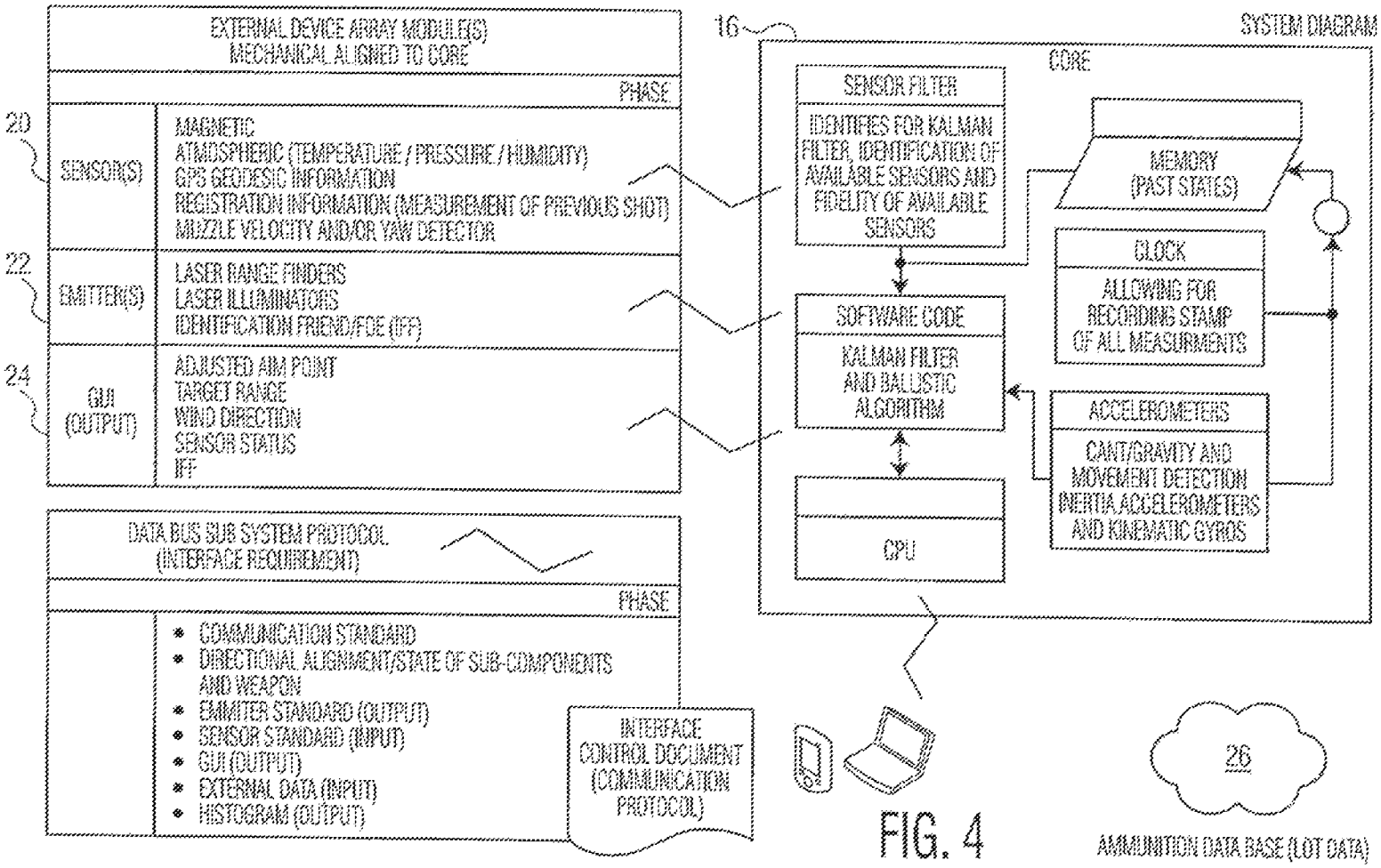
FIG. 4 is a system diagram showing the interrelationship and operation of the various electronic components according to the invention.

The operation of the system according to the invention is illustrated in FIG. 4. The core component 16 receives data from an array of sensors 20, radiation emitters 22 and other electronic components 24 that determine wind direction, target range, weapon orientation (FIG. 3) and the like. The core component also receives ballistic data and ammunition lot data from a cloud 26 and calculates precision aiming data for the weapon.

Figure 5:
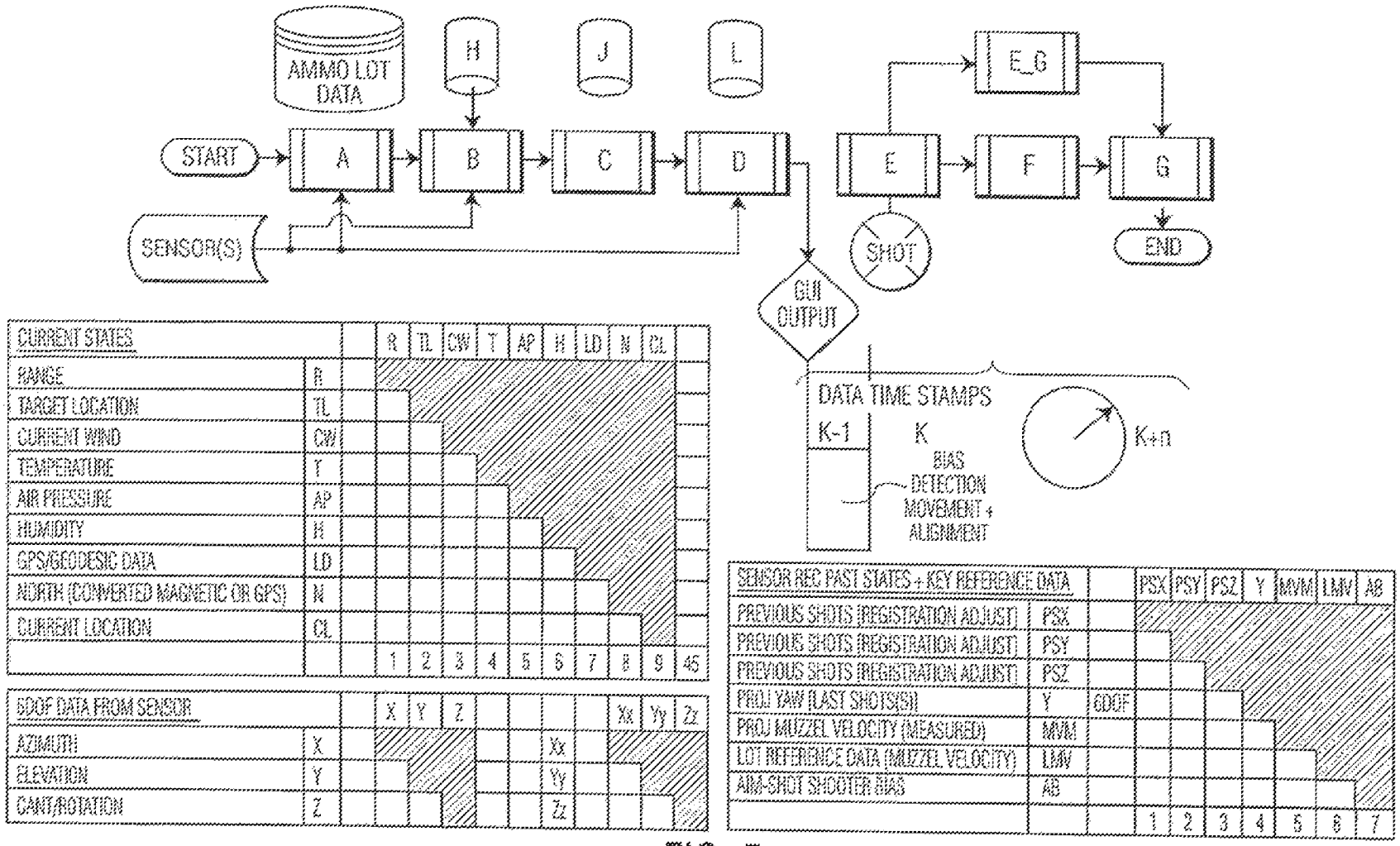
FIG. 5 is a system diagram showing the software, firmware, circuitry logic and ballistic algorithm subroutines.

The software, firmware, circuitry logic and ballistic algorithm subroutines are illustrated in FIG. 5. The "core" component includes the following key software, firmware, circuitry logic and programming logic with certain key functions and characteristics:

Sensor Transmission and Input:

The sensor modules utilize a standardized signal code to transmit data to the core. The signal code protocol identifies both the availability of a sensor type and sensitivity capability of sensors (see FIG. 4).

Ballistic Algorithm for All Sensor Combinations:

The standardized data transmission protocol and ballistic algorithm is constructed to utilize all combinations of sensor inputs and utilizes the identification of sensor sensitivity in computations (see FIG. 4).

Filter Sensor Data:

The programming subroutine includes truth table subroutines that verify that all sensor data inputs are within nominal ranges. This filtering subroutine precludes incorrect computation output solutions. The filter also provides for selection of the most sensitive functioning sensor where multiple sensors may have duplicate inputs (see FIG. 5).

Core Measurements:

The core device includes accelerometers and kinematic gyros detecting, measuring and recording the angular six degrees of freedom (movement) measurements of the sensors mounted on the rail, prior to a shot (k−1) and at the time of shot (k), whereby this information is recorded and stored in memory contained in the "core" (see FIG. 3).

Clock and Data Recording:

The core device includes a clock and memory allowing for recording of time stamp information on all key shot measurements (k−1 and k) (see FIG. 5).

Memory:

In addition to recording the time stamp information of the actual sensor readings prior to and at the time of shot, a ballistic algorithm (subroutine) uses the stored actual data and records a second set of adjusted shot placement readings adjusted for standard reference settings. The memory stores an operating system's software code (see FIG. 5).

EXAMPLE

In the event that a shot is recorded at a high altitude where the air is thinner and the projectile travels faster, the core records the actual sensor readings and a subroutine calculates an adjustment of the actual readings to record a set of standardized altitude conditions.

The ballistic algorithm provides program software code that uses sensor data, accesses data bases and executes a series of subroutines using algorithm relying on regressive analysis techniques as identified in FIG. 5. The regressive algorithm utilizes NATO "Modified Point Mass" or three Degree-of-Freedom (DOF) analysis mathematical methodologies published by McCoy or as disclosed in other well-known publications on ballistics. Note that "G function" ballistic techniques correlating known projectile design drag/velocity coefficients are not utilized as "long shorts" are desired and the exact supersonic to sub-sonic transition is calculated using an equation that, preferably, uses "current state" sensor atmospheric data. The code heavily relies on the computation of "Magnus moment" and utilization of the "initial firing geometry." The regression algorithm utilizes a series of filters and data bases where "prior state" data is stored.

Figure 6:
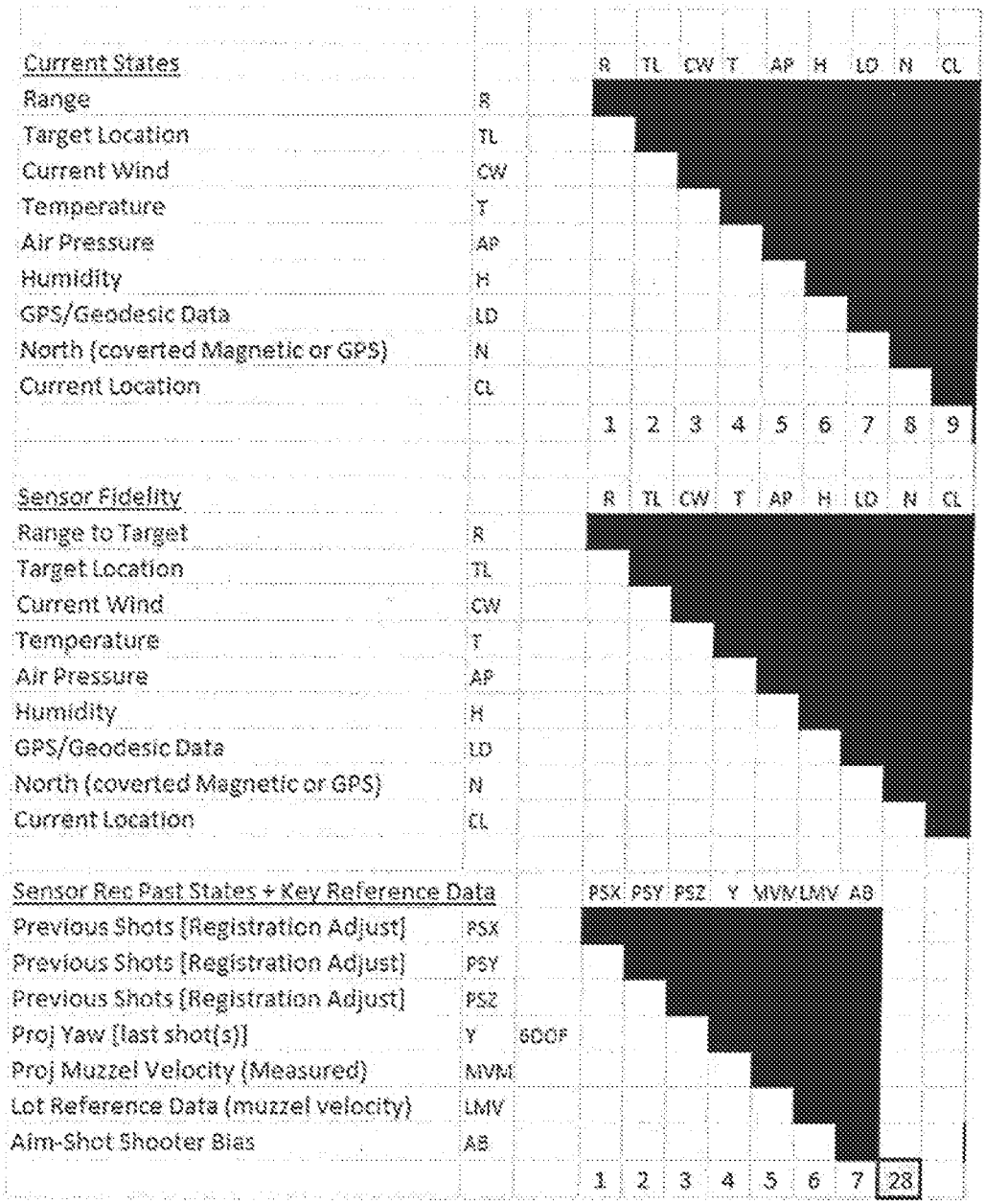
FIG. 6 is a fable showing various combinations of sensors which may be used with the system according to the present invention.

Sensor Combinations:

The combinations of sensors are shown in the Table appearing in FIG. 6.

Subroutines and Databases:

The subroutines and databases identified by the letters A-J in FIG. 5 are as follows:

Subroutine A—Sensor data is checked to verify data is in an allowable range (truth table).

Subroutine B—With identification of sensors combinations, the algorithm accesses default data from data base "H" and computes a probabilistic "best fit" solution using Non-Linear Kalman Filter techniques and methods.

Subroutine C—"Prior State Data" in data base "J" is compared to results of Subroutine B solution. If available, ammunition data base information is used in the subroutine. This subroutine also utilizes bias error (histograms) located in data base "L" to the refine solution.

Subroutine D—A final regression analysis subroutine (again using Non-Linear Kalman Filtering techniques) with a bias check sub-routine generates the final solution that the operating system will display in the GUI.

[SHOT is Taken]

Subroutine E—Pre-shot biases are recorded in data base "L". Actual "Registration of shot data/time" information such as projectile yaw, muzzle velocity and position in flight/time or position at impact/time is collected and loaded to prior state data base "J."

Subroutine F—Bias Error analysis from shot is executed and data base "L" is updated.

Subroutine G—Regression analysis executed on results of Subroutine E, standardizing data re-set to nominal conditions recording results in data base "J" for use in subsequent shot calculation.

H—Default data base.

L—Bias data base.

J—Prior (shot) State data base.

Reference Data (in Memory) from External Data Bases:

The CPU, with software and memory, may utilize manufacturer and/or other data to calculate improved ballistic solutions. Examples of reference data include: Lot Mean Muzzle Velocity, propellant burn variation by temperature/pressure, manufacturer or supplier lot acceptance data.

There has thus been shown and described a novel precision aiming apparatus for a weapon which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A precision aiming apparatus for a weapon having a barrel for firing a projectile and a rail aligned with a centerline of the barrel, said rail including a bus for supplying power to, and providing communication between, electronic components that are mounted on said rail, said aiming apparatus comprising, in combination:

(a) a core component, configured to be mechanically mounted on and electronically coupled to the rail, having a central processor unit with a data memory and operable (1) to receive sensor data from a plurality of electronic sensor components; (2) to store said sensor data in said data memory; (3) using both current and prior sensor data, to calculate optimized aiming data for an optimum aim of the barrel with respect to a target; and (4) to transmit a signal with said optimized aiming data to an output display, thereby producing an optimized aiming solution useful to an operator for precision aiming of the weapon;

(b) an input device, coupled to said core component, for receiving external data and operator commands for use by said core component;

(c) an output display, configured to be mechanically mounted on and electrically coupled to said rail and thereby coupled to said core component, for displaying said optimized aiming data produced by the core component; and (d) said plurality of electronic sensor components, which are coupled to said core component, being selected from the group consisting of:

(1) an optical sensor configured to detect light received from a projectile fired from the weapon;

(2) a range finder configured to determine range to a target;

(3) a temperature sensor configured to detect ambient temperature;

(4) an air pressure sensor configured to detect ambient air pressure;

(5) an humidity sensor configured to detect the relative humidity in the air;

(6) a GPS locator configured to detect a current location;

(7) a magnetic compass configured to detect earth's magnetic field;

(8) a muzzle velocity sensor configured to detect a velocity of the projectile fired from the weapon;

(9) a yaw angle sensor configured to detect yaw of the gun barrel during firing;

(10) a wind sensor configured to detect wind direction and velocity;

(11) a wind gust and turbulence sensor configured to detect wind turbulence;

(12) a target location sensor configured to determine spatial coordinates at a target location;

(13) a geodesic sensor to determine terrain at a target location; and

(14) a projectile location sensor that determines an observed location of a projectile in flight;

wherein said core component receives sensor data from said electronic sensor components when a shot is fired from said weapon and is operative (1) to compare said sensor data with a truth table of valid data ranges to eliminate false sensor data, (2) to compare and filter current state sensor data with prior state sensor data to calculate an adjusted, optimized aim point for a subsequent shot, and (3) to produce an output signal for transmission to said output display for a display of said optimized aim point, thereby allowing said operator to more precisely aim the weapon at a selected target.

2. The aiming apparatus of claim 1, wherein said output display is an optical sight with a built-in electronic display adapted to be mounted on said weapon and configured to display said target.

3. The aiming apparatus of claim 1, wherein said core component, which is mechanically mounted on and electronically coupled to said rail, communicates with said input device, said output display and with said electronic sensor components by means of said bus on said rail.

4. The aiming apparatus of claim 1, further comprising a laser emission source adapted to be mounted on said weapon and configured to illuminate a said target with a laser beam when initiated by one of said core component and said input device.

5. The aiming apparatus of claim 4, wherein said laser source is adapted to be mechanically mounted on said rail and to communicate with said core component by means of the bus on said rail.

6. The aiming apparatus of claim 1, wherein said core component includes an internal clock and is operable to generate a histogram of the rail's orientation prior to a shot and to store the histogram in the data memory.

7. The aiming apparatus of claim 1, wherein said core component includes at least one of an accelerometer and movement-detecting gyro and is operable to store at least one of movement and acceleration measurements in the data memory.

8. The aiming apparatus of claim 1, wherein ballistic data is stored in said memory and wherein said core component adjusts said aiming data for said output display in accordance with said ballistic data.

9. The aiming apparatus of claim 1, wherein ammunition lot data is obtained and stored in said data memory and wherein said core component adjusts said aiming data for said output display in accordance with such lot data.

10. The aiming apparatus of claim 9, wherein said ammunition data is obtained by at least one of a download from the Internet and a transfer of data from an external data storage device.

11. The aiming apparatus of claim 1, wherein ammunition lot data is received by said input device for storage in said data memory.

12. The aiming apparatus of claim 1, wherein said core component uses angular and movement detection (AMD) data in the calculation of said optimized aiming data.

13. The aiming apparatus of claim 1, wherein said core component filters said sensor data using a said truth table to verify that they are within normal ranges.

* * * * *